US005100466A

United States Patent [19]

Blenk

[11] Patent Number: 5,100,466

[45] Date of Patent: Mar. 31, 1992

[54] PROCESS FOR PURIFYING LEAD USING CALCIUM/SODIUM FILTER CAKE

[75] Inventor: Michael H. Blenk, Youngstown, N.Y.

[73] Assignee: E. I. du Pont de Nemours and Company, Wilmington, Del.

[21] Appl. No.: 693,852

[22] Filed: May 2, 1991

[51] Int. Cl.[5] ..... C22B 13/06

[52] U.S. Cl. ..... 75/702

[58] Field of Search ..... 75/701, 702, 408

[56] References Cited

U.S. PATENT DOCUMENTS

| | | | |
|---|---|---|---|
| 1,428,041 | 9/1922 | Kroll | 75/702 |
| 2,110,445 | 3/1938 | Lefferrer . | |
| 2,765,328 | 10/1956 | Padgitt | 260/437 |
| 4,033,761 | 7/1977 | Di Martini et al. . | |
| 4,153,451 | 5/1979 | Crasto et al. . | |
| 4,333,763 | 6/1982 | Di Martini et al. . | |
| 4,404,026 | 9/1983 | Di Martini et al. | 75/702 |

OTHER PUBLICATIONS

"Sodium Treatment of Copper Dross", C. Bates and C. Di Martini, Journal of Metals, Aug. 1986, pp.43–45.

"Process for Separating Impurities from Crude Lead Bullion Via Sodium Metal Injection", M. B. Blenk, R. B. Diemer and J. P. Hager, International Symposium on Injection in Process Metallurgy, 2-21-91.

*Primary Examiner*—Melvyn J. Andrews

[57] ABSTRACT

A method for processing crude lead bullion using a reactive metal mixture intermediate by-product having sodium and calcium includes the steps of pouring molten crude lead bullion from a blast furnace into a casting vessel, cooling the crude lead bullion so that a crust forms on top thereof, punching a hole in the crust, injecting a reactive metal mixture intermediate by-product comprising sodium and calcium below the crust and into the crude lead bullion, and allowing the contents of the casting vessel to cool to form three equilibrium phases, including a bottom phase of refined lead bulletin, a speiss phase formed on top of the lead bullion phase and including $Cu_3As$ and $Fe_2As$, and a matte phase formed on top of the speiss phase and including copper, sodium, calcium and sulfur.

A method for processing a previously-produced lead dross containing entrained lead using a reactive metal mixture intermediate by-product includes adding molten lead to a kettle, agitating the lead, adding a reactive metal mixture intermediate by-product comprising sodium and calcium to the lead to form an alloy of lead, sodium and calcium, adding a lead dross comprisingy $Cu_2S$, PbS and entrained lead to the alloy, discontinuing the agitation, and allowing the alloy to equilibrate to form a matte phase including $Cu_2S$, $Na_2$ S, CaS and CaO and a lead phase that included a portion of the lead that was formerly entrained and/or chemically bound in the dross.

18 Claims, No Drawings

PROCESS FOR PURIFYING LEAD USING CALCIUM/SODIUM FILTER CAKE

BACKGROUND OF THE INVENTION

1. Field of the Invention

This invention relates to a process for purifying crude lead bullion, and more particularly relates to a process for purifying the crude lead bullion using intermediate by-products comprising sodium and calcium that must otherwise be processed or disposed of. The invention also relates to a process for treating a rough dross produced from a crude lead bullion purification step to separate out useful lead in the dross using intermediate by-products comprising sodium and calcium that must otherwise be processed or disposed of. These intermediate by-products, which are commonly referred to as a "reactive metal mixture", include a sodium filtration filter cake produced as a by-product in the manufacture of sodium, sodium sludge pellets which are obtained by squeezing sodium from a sodium filtration filter cake in a press, and sodium tankcar and storage tank heels that are obtained when the tankcars and storage tanks are cleaned.

2. Description of the Related Art

Lead bullion often contains impurities such as copper and sulfur. Copper is usually removed from the lead because the copper is a valuable resource. Sulfur is usually removed from lead because it is an undesirable contaminant.

In a typical process for removing these impurities, the bullion is tapped from a blast furnace at approximately 1200° C. and then poured into a kettle. As the bullion cools, most of the copper and sulfur entrained in the lead precipitates on top of the lead in what is known as a rough dross, also known as a rough copper dross or "wet" dross, which is skimmed from the lead bullion by a crane ladle for further processing to recover the lead entrained in the dross.

The rough dross has a low copper content and a high lead content and contains, typically, 15 wt% copper sulfide ($Cu_2S$), 41 wt% lead sulfide (PbS), and 41 wt% metallic lead (Pb) mechanically entrained or occluded therein.

The rough dross is a heterogenous mixture of three phases, including a matte phase, a speiss phase, and an entrained lead phase. The matte phase is composed primarily of a mixture of PbS and $Cu_2S$, while the speiss phase usually includes entrained lead, copper arsenide ($Cu_3As$), copper antimonide ($Cu_3Sb$), and iron arsenide ($Fe_2As$), intermingled with an additional emulsion of very fine PbS-$Cu_2S$ matte particles. The rough dross is processed further to recover the lead entrained in the speiss together with the PbS contained in the matte.

The rough dross is usually processed by charging it into a reverberatory furnace together with reagents such as soda ash and coke. The dross is melted in the furnace to form a separate matte phase, a speiss phase, and a pool of elemental lead. The matte and speiss phases each contain about 10–15% lead.

The processing of the dross in the reverberatory furnace liberates some of the lead entrained therein, which flows down into a molten lead pool below the matte and speiss phases. Processing the dross in this manner to remove lead from the dross is expensive and energy intensive because it involves considerable physical and mechanical handling of large quantities of hot bullion and dross, it is environmentally obnoxious because it produces hazardous fumes, and it is one that the art is desirous of eliminating from the lead processing cycle.

It has been discovered that certain alkali-metal containing materials, notably metallic sodium, improve the separation of crude lead from a dross. The improvements are realized by the strong reducing behavior of sodium, wherein residual lead sulfide is converted to lead, and by the production by the sodium of a matte phase that is fluid in nature, and which forms as a separate layer instead of a heterogenous dross. The matte permits most of the lead which would normally be entrained in the dross to enter the bullion instead.

The movement of the lead to the bullion from the matte is important because the resulting copper to lead ratio in the matte is high enough to make the matte acceptable to copper smelters, which ultimately reclaim copper from the matte. Additionally, this type of purification obviates the need for traditional reverberatory furnace processing. Further, the weight of the matte is decreased because it contains less lead, which reduces potential shipping costs for the matte.

U.S. Pat. No. 4,404,026, which is incorporated herein by reference, discloses a process for separating elemental lead from a blast furnace bullion containing a substantial amount of lead sulfide comprising the steps of forming a pool of molten lead bullion, preferably having a temperature of about 1100°–1200° C., transferring the bullion into a container such as a cast iron mold which is resistant to molten lead, cooling the bullion to a predetermined temperature of about 700°–800° C. while forming a partial matte crust over the surface of the bullion, and adding a sodium-containing reagent selected from the group consisting of metallic sodium, sodium carbonate or soda ash ($Na_2CO_3$) and $Na_2CO_3$/-coke to the lead bullion, with a preferred sodium-containing reagent being liquid metallic sodium in amounts of 0.5–4.0 weight percent of the bullion.

The metallic sodium reagent, which is preferably heated to just below 120° C., is added to the lead bullion beneath the surface of the lead pool, so as to avoid an oxidation reaction of the reagent with air. The sodium then reacts with the lead-bearing substances, present primarily as PbS of the matte, together with a smaller amount of PbS found in the speiss, to form elemental lead, while a matte primarily comprising a mixture of sodium sulfide ($Na_2S$) and $Cu_2S$ and a speiss comprising primarily a mixture of $Cu_3As$, $Cu_3Sb$ and $Fe_2As$ forms on the surface of the molten lead pool, with the elemental lead that is formed falling into the molten lead pool. Upon further gradual cooling to a temperature of about 350°–400° C., the matte and speiss each have a low lead content which is no more than the level of that found in the speiss and matte produced by a dross reverberatory furnace, and can be substantially less.

U.S Pat. No. 4,333,763, which is incorporated herein by reference, discloses a process for recovering lead from a previously-produced dross that contains lead sulfide and copper sulfide and has metallic lead entrained or occluded therein. Such a dross is exemplified by a rough copper dross, obtained from the rough copper drossing of lead bullion by the liquating of molten lead bullion in a conventional manner and then cooling the molten lead to a temperature of typically about 450° C.

The process includes establishing a pool of molten lead in a kettle and incorporating sodium metal in the lead pool in an amount sufficient to reduce the combined lead in the lead sulfide of a rough dross to metallic lead, adding the rough dross to the molten lead, mixing together the sodium metal, molten lead, and rough dross at a temperature in the range of the melting point of metallic lead up to about 650° C. to allow the sodium metal to react with the lead sulfide to reduce the combined lead of the lead sulfide to metallic lead and to produce a matte phase comprising sodium sulfide that has separated from the molten lead, with the thus-liberated metallic lead reporting in the molten lead pool and the sodium sulfide being present in the matte phase, and separating the matte phase from the lead pool.

U.S. Pat. No. 4,153,451 discloses recovering lead from a tetraethyl lead (TEL) sludge in a high temperature (900°-1000° C.) smelting process using a reactive metal mixture in place of sodium. This sludge is a by-product in the manufacture of TEL. In a first step of the recovery process, wet TEL sludge is dried, and the dry TEL sludge is combined with RMM to produce lead and a residue. The composition of the RMM is approximately 70% sodium and 5-30% calcium and the composition of the TEL sludge is 45-75 wt% lead.

Turning now to the reactive metal mixture, the manufacture of sodium metal includes a step of passing molten sodium through a filter to remove calcium, which is an undesirable by-product. The material remaining on the filter is a cake of sodium metal, calcium metal, and oxides of these metals with trace amounts of metal chlorides. This sodium/calcium filter cake, which is also known as a reactive metal mixture (RMM), is subsequently charged to a kettle where the RMM undergoes a recovery process to recover useful sodium. The cost of operating the sodium recovery process, however, is significant.

The RMM may also be pressed hydraulically to remove some of the residual sodium, producing "sludge pellets" which may be utilized as RMM in refining lead.

A reactive metal mixture is also produced by recovering the heels of sodium tankcars and storage tanks.

These various processes produce a large amount of RMM material, which is undesirable because if sodium is not recovered from the RMM, the disposal of RMM is difficult and expensive. RMM may be disposed of by reacting it with water to form sodium hydroxide (NaOH), but the NaOH is a very impure grade and this reaction can be hazardous.

Reusing RMM to produce sodium in electrolytic cells is also undesirable because it is an expensive process that requires high temperatures and causes rapid deterioration of equipment. This process is also undesirable due to unpredictable violent reactions.

SUMMARY OF THE INVENTION

It is an object of this invention to provide a process for purifying lead bullion that utilizes an intermediate by-product comprising sodium and calcium, namely, a reactive metal mixture that includes sodium and calcium.

It is another object of this invention to provide a process for treating a previously-produced rough dross that utilizes an intermediate by-product comprising sodium and calcium, namely, a reactive metal mixture that includes sodium and calcium.

These and other objects of the invention are accomplished by a method for processing crude lead bullion using a reactive metal mixture that includes sodium and calcium comprising the steps of pouring molten crude lead bullion from a blast furnace into a casting vessel, cooling the crude lead bullion so that a crust forms on top of the bullion, punching a hole in the crust, injecting a reactive metal mixture comprising sodium and calcium below the crust and into the crude lead bullion, and allowing the contents of the casting vessel to cool to form three equilibrium phases: a bottom phase of refined lead bullion, a speiss phase formed on top of the bullion phase that includes $Cu_3As$ and $Fe_2As$, and a matte phase formed on top of the speiss phase that includes copper, sodium, calcium and sulfur.

Another aspect of the invention is a method for processing a previously-produced lead dross by using a reactive metal mixture to recover lead entrained or chemically bound in the dross, comprising the steps of adding molten lead to a kettle, agitating the lead, adding a reactive metal mixture comprising sodium and calcium to the lead to form an alloy of lead, sodium and calcium, adding a previously-produced lead dross that includes $Cu_2S$, PbS and entrained lead to the alloy in the kettle while continuing to agitate the contents of the kettle, discontinuing the agitation, and allowing the alloy to equilibrate to form a top matte phase including $Cu_2S$, $Na_2S$, calcium sulfide (CaS) and calcium oxide (CaO), and a bottom lead phase that includes a portion of the lead that was entrained in the dross.

DETAILED DESCRIPTION OF THE INVENTION

The present invention relates to a method of purifying crude lead bullion using intermediate by-products comprising sodium and calcium that must otherwise be processed or disposed of. The invention also relates to a method of treating a previously-produced rough dross using intermediate by-products comprising sodium and calcium. The intermediate by-products, which are commonly referred to as a "reactive metal mixture" (RMM), include, for example, a sodium filtration filter cake that is a by-product of the manufacture of sodium metal, processed sodium sludge pellets from a sludge press, and sodium tankcar and storage tank heels that are obtained when the tankcars and storage tanks are cleaned.

One source of reactive metal mixture is an intermediate by-product of the manufacture of sodium metal. The manufacture of sodium metal is discussed in the Kirk-Othmer *Encyclopedia of Chemical Technology*, Third Edition, Volume 21, pages 187-192, the text of which is incorporated herein by reference.

One process for the manufacture of sodium metal is the electrolysis of fused sodium chloride in a Downs cell. The cell includes a multiple electrode arrangement having four anodes in a square pattern, with each anode surrounded by a cylindrical diaphragm and cathode. Calcium that remains in the sodium manufactured by this process is removed by filtration of the sodium at about 110° C., with the final sodium product containing less than 0.04 wt% calcium. The filtration operation produces a cake of calcium, sodium, chlorides, and oxides, and is known as a reactive metal mixture (RMM).

RMM may also be obtained from the heels of sodium tankcars and sodium storage tanks and from processed sodium sludge pellets from sludge press.

Examples of various RMMs which may be used in the invention, together with the component compositions of those RMMs, are shown in Table 1 below.

TABLE 1

| RMM | Component | Nominal Wt. % | Range Wt. % Sodium |
|---|---|---|---|
| Sodium Filtration | Na | 70 | 60-90 |
| Filter Cake | Ca | 20 | 10-30 |
| | oxides | 5 | 0-10 |
| | other | 5 | 0-5 |
| Tankcar & Storage Tank | Na | 90 | 85-95 |
| Heels | Ca | 2 | 0-5 |
| | oxides | 8 | 5-15 |
| Processed Sodium Sludge | Na | 55 | 20-65 |
| Pellets from | Ca | 30 | 25-70 |
| Sludge Press | oxides | 15 | 5-33 |

The RMM may also include other alkali metal or alkaline earth metal elements or alloys, such as potassium, lithium, magnesium and beryllium.

PROCESSING CRUDE LEAD BULLION

One aspect of the invention includes processing crude lead bullion using the RMM. The crude lead bullion is tapped from a blast furnace at about 1200° C., and is then poured from the blast furnace into a casting vessel where the bullion is allowed to cool to about 800° C. to form a crust on top of the bullion. A hole is punched in the crust, and the reactive metal mixture is forced into the molten bullion below the crust so as to avoid an oxidation reaction of the RMM with air. The RMM is preferably heated to just below 120° C. before being added to the lead bullion.

The casting vessel is allowed to cool so that the contents of the vessel form three equilibrium phases: a bottom phase of refined lead bullion, a speiss phase formed on top of the lead bullion phase and including $Cu_3As$ and $Fe_2As$, and a matte phase formed on top of the speiss phase and including copper, sodium, calcium and sulfur.

After cooling, the matte and speiss phases may be separated from the lead by mechanical means to further process the matte and speiss phases.

The inventive process may be illustrated as follows.

$$\text{1. Pb bullion } (\approx 1200^\circ\text{ C.}) \xrightarrow[\text{cooled}]{} \text{Pb + crust}$$

$$\text{2. Pb + crust + RMM } (\sim 800^\circ\text{ C.}) \xrightarrow[\text{cooled}]{} \text{Pb + matte + speiss.}$$

The following reactions occur in the molten lead:

(a) $Ca + Na_2O \rightarrow CaO + 2Na$ (b) $Ca + 2NaCl \rightarrow CaCl_2 + 2Na$ (c) $2Na + PbS/Cu_2S/Pb$ (entrained) $\rightarrow Na_2S/Cu_2S$ (matte) $+ Pb$ (d) $Ca + PbS/Cu_2S/Pb$ (entrained) $\rightarrow CaS/Cu_2S$ (matte) $+ Pb$ (e) $2Na + Cu_2S \rightarrow Na_2S + 2Cu$ (f) $3Cu + As \rightarrow Cu_3As$ (Speiss)

(g) $3Cu + Sb \rightarrow Cu_3Sb$ (h) $Ca + Cu_2S \rightarrow CaS + 2Cu$

The dosage level of RMM is approximately 1 to 2 equivalent weight percent of the crude lead bullion (as equivalent sodium), with each mole of calcium equivalent to two moles of sodium.

The equivalency of calcium to sodium is based on the following analysis. Calcium reacts with bound sodium as follows:

$$Ca + Na_2O \rightarrow 2Na + CaO$$

$$Ca + 2NaCl \rightarrow 2Na + CaCl_2$$

Thus, each gram mole of calcium present is expected to behave as 2 gram moles of sodium, either in directly reducing sulfides or in liberating sodium to combine with sulfur, antimony and arsenic.

RMM may also be used in conjunction with iron or iron compounds such as $FeS_2$ to promote further anion redistribution, with $Fe_2As$ being prominent in the speiss phase.

Crude lead with a sulfur concentration in the range of about 0.1 to 3 weight percent may be treated with RMM in an amount such that the number of sodium equivalents in the RMM is sufficient to reduce lead sulfide and to enhance the formation of separable intermetallic phases with antimony and arsenic. $Cu_2S$ may also be added to the RMM to promote the fluidity of the matte phase.

The temperature of the RMM should be in a preferred range of 20°-120° C. Higher temperatures may be used, but when the temperature increases above 120° C., the risk of auto ignition of the RMM increases.

The temperature of the bullion in the cooling phase should be about 800° C. At temperatures below 750° C., the phase separation and phase liquidity are poor. Temperatures as high as 870° C. are feasible.

The presence of sulfur in the Pb bullion is important to the utility of the invention. Sulfur levels which have been successfully treated with sodium or RMM are tabulated below:

| Range of [S] Wt. % | Na Source |
|---|---|
| 0.35-1.4 | Na |
| to 1.6 | Na (U.S. Pat. No. 4,404,026) |
| to 2.3* | Na & RMM |

*added $Cu_2S$ included.

It has been demonstrated that copper concentration in the lead bullion can be 2.5-11.4%, but these are not absolute limits. In general, the higher the Cu:S ratio, the less equivalent Na is required for treatment. The addition of $Cu_2S$ is not required for reduction of the sodium of the RMM. Its addition may be desirable, however, to promote the fluidity of the matte produced from some compositions of bullion.

Bullions successfully treated with sodium have included elements in the following concentrations:

| Element | Concentration Wt. % |
|---|---|
| As | 1-1.5 |
| Sb | 0.34-3.8 |
| Ag | 0.12-1.04 |
| Fe | trace |
| Zn | trace |
| Sn | trace |
| Pb | 77.5-94.4 |

The inventive process may be carried out in an inert atmosphere but the inert atmosphere is not essential. The time for mixing of the RMM with the bullion is less than 8 hours. Elemental distribution achieved between the bullion, matte and speiss phases is:

| Element | Bullion | Matte | Speiss |
|---|---|---|---|
| Cu | very low | high | high |
| As | low | low | high |
| S | very low | high | low |
| Pb | very high | low | low |
| Na | very low | very high | low |

TREATMENT OF A PREVIOUSLY-PRODUCED DROSS

Another aspect of the present invention is a method for treating a previously produced lead dross. Molten lead is added to a kettle, and agitated. A reactive metal mixture intermediate by-product comprising sodium and calcium, as described above, is added to the kettle, and the contents of the kettle are continued to be mixed to create an alloy of lead, sodium and calcium, which gives off heat.

The amount of RMM is selected to be approximately 2 weight percent (as equivalent sodium) of the lead/RMM alloy, where each mole of calcium is equivalent to 2 moles of sodium.

A previously-produced lead dross, which is largely $Cu_2S$, PbS and entrained Pb, is added to the kettle, and the contents of the kettle are continued to be agitated. After a thorough mixing, the agitation of the kettle is discontinued, and the contents of the kettle are allowed to equilibrate.

A matte phase disengages from the bulk of the bullion, and includes $Cu_2S$, $Na_2S$, CaS and CaO. The CaO is formed as a result of oxides introduced with the RMM.

The matte phase has a high copper to lead ratio, in the range of 4:1 to 8:1, and may be separated from the lead for processing to recover the copper. The lead that was entrained and chemically bound in the dross reports, or falls into, the lead bullion phase. In the resulting product, the matte has a lead content of from 3% to 10%.

This process may be outlined as follows:

98% Pb + 2% RMM (as effective Na) +

$$\text{Pb dross kettle} \xrightarrow{T = 550\text{-}750^\circ\ C.} \text{Pb + matte.}$$

Lead drosses amenable to treatment contain sulfur in the form of PbS and $Cu_2S$, and entrained elemental Pb which can be liberated by the destruction of the sulfide matrix that retards transfer of lead metal in the bullion. The concentrations of antimony and arsenic in the dross should not be too high. Examples of such drosses are those skimmed from crude bullion smelted from Missouri ore concentrates.

Mixing temperatures in the kettle range from 550° to 750° C.

EXAMPLES OF PROCESSING CRUDE LEAD BULLION

These examples compare the use of RMM to the use of sodium metal, and to alkali-free heat treatment, in refining crude lead bullion in a controlled fashion. The examples illustrate the benefits of RMM addition as well as the effective substitution of RMM for Na.

Test Procedure

Pyrometallurgical tests were conducted on a granulated crude lead bullion obtained from a commercial blast furnace that was operated by a primary lead smelter. This crude bullion sample had the following elemental composition:

| | | | |
|---|---|---|---|
| COPPER | 5.11 WT % | IRON | 0.15 WT % |
| SULFUR | 1.27 WT % | ANTIMONY | 0.39 WT % |
| TIN | 0.11 WT % | SODIUM | 0.001 WT % |
| ARSENIC | 1.50 WT % | ZINC | 0.09 WT % |
| SILVER | 0.204 WT % | LEAD | 91.2 WT % (by difference) |

Approximately 1360 grams of the homogenized crude bullion were charged to fireclay crucibles for testing. In addition, 31.8 grams of copper sulfide ($Cu_2S$) were added to the bullion to improve fluidity of any resultant matte phase. All samples were individually heated to 800° C. in a cylindrical electric furnace in the presence of an inert atmosphere of nitrogen ($N_2$). For those tests where a reactive metal mixture or sodium was added to the crucible, a ⅜ diameter stainless steel injection probe was lowered into the now molten lead bath. The RMM or sodium metal was added to the molten lead, and was followed by a heavy plug of pure lead. The RMM or sodium was allowed to melt and be forced beneath the surface of the lead bath by gravity and modest nitrogen pressure. The probe was subsequently withdrawn.

The test crucibles were allowed to equilibrate at 800° C. for 8 hours without agitation. At the end of that period, the heat source was removed, the furnace was opened, and cooling air was blown against the furnace to promote rapid cooling. This cooling was done to quench the phases, thus preserving equilibrium compositions without further transport of species, or mixing of the phases, as might occur during a prolonged cool-down period. Once the materials in the crucibles solidified, the crucibles were cut away to reveal boundaries of the phases. The samples were photographed, and the individual phases were weighed and tested for compositional analysis. Results from three test crucibles are presented here.

EXAMPLE 1

This example was a control experiment wherein the crude lead bullion was subjected to heat treatment alone, without the benefit of the addition of RMM or sodium or any alkali or alkaline earth metal. In this example equilibrium phases were not attained, and a low density "mattelike" material was left above the bullion. This low density material was a matrix that contained poorly dissociated matte and speiss phase components, along with an unacceptably large amount of bound and entrained lead metal.

| CRUCIBLE CHARGE | | CRUCIBLE PRODUCT | |
|---|---|---|---|
| CRUDE BULLION: | 1360.1 g | "MATTELIKE" MATRIX: | 110.8 g |
| $Cu_2S$: | 31.8 g | REFINED BULLION: | 1139.0 g |

| | ANALYSES [WT %] | | |
|---|---|---|---|
| ELEMENT | CHARGE | MATTELIKE | BULLION |
| copper | 6.8 | 54.36 | 1.33 |
| sulfur | 1.72 | 16.63 | 0.037 |
| lead | 89.1 | 26.92 | 97.37 |
| tin | 0.11 | 0.03 | 0.018 |
| arsenic | 1.47 | 1.69 | 0.63 |
| silver | 0.20 | 0.127 | 0.212 |
| iron | 0.15 | 0.84 | 0.001 |
| antimony | 0.38 | 0.10 | 0.40 |

-continued

| | | | |
|---|---|---|---|
| sodium | 0.001 | 0.01 | 0.002 |
| zinc | 0.09 | 0.34 | 0.001 |

EXAMPLE 2

In this example, 1.66 wt % sodium as sodium metal was injected into a test charge of crude bullion using the test procedure described above. This charge represented 129% of the amount of sodium which would theoretically be required t react to form $Na_2S$, $Na_3As$ and $Na_3Sb$ with all the sulfur, arsenic and antimony not already capable of being bound by the amount of copper contained in the system. Adding sodium metal, and then allowing the contents of the crucible to equilibrate for 8 hours, promoted separation of phrases and components as noted below:

| CRUCIBLE CHARGE | | CRUCIBLE PRODUCT | |
|---|---|---|---|
| CRUDE BULLION: | 1349.6 g | MATTE: | 45.73 g |
| $Cu_2S$: | 31.8 g | SPEISS: | 43.64 g |
| SODIUM METAL: | 27.3 g | BULLION: | 1421.82 g |
| LEAD "FOLLOWER": | 238.5 g | | |

| | ANALYSES [WT %] | | | |
|---|---|---|---|---|
| ELEMENT | CHARGE | MATTE | SPEISS | BULLION |
| copper | 6.8 | 34.9 | 57.9 | 0.60 |
| sulfur | 1.72 | 25.7 | 0.36 | 0.01 |
| lead | 89.1 | 3.21 | 11.8 | 98.8 |
| tin | 0.11 | 0.42 | 0.53 | 0.05 |
| arsenic | 1.47 | 2.93 | 16.6 | 0.09 |
| silver | 0.20 | 0.23 | 0.157 | 0.173 |
| iron | 0.15 | 5.68 | 0.44 | 0.001 |
| antimony | 0.38 | 0.05 | 3.72 | 0.32 |
| sodium | 0.001 | 26.2 | 0.29 | 0.004 |
| zinc | 0.09 | 0.85 | 0.03 | 0.001 |

These data show that the sodium caused the formation of a copper sulfide/sodium sulfide matte phase, while arsenic, as copper arsenide, is present in the speiss phase. The purity of the lead bullion was improved and valuable silver was retained in the bullion. Relatively little of the total system lead was found outside the bullion.

EXAMPLE 3

In this example, 28.3 grams of a reactive metal mixture (RMM), as recovered from the sodium filtration process, were added to the crude lead bullion in lieu of the sodium metal using the test procedure described above. The RMM was analyzed as follows:

| | |
|---|---|
| SODIUM: | 79.4 WT % |
| CALCIUM: | 18.2 WT % |
| OXIDES: | 0.4 WT % |
| ALL OTHER: (CARBONATES, CHLORIDES) | 2.0 WT % |

The RMM had a sodium equivalency on a weight basis of 98%. The 28.3 grams of RMM in this Example, therefore, represented an equivalent sodium dosage of 129.6% of that stoichiometrically required, which was very similar to the sodium dosage of Example 2.

Although the RMM filter material was not fully fluid, it was cast into cylindrical rods and successfully injected into the crucible. After equilibration, three distinct phases had formed, but the matte phase tended to be harder in nature than that obtained with use of pure sodium. This may be attributed to the presence of CaO, $CaCo_3$ or other contaminants from the RMM filter cake. This decrease in fluidity caused some retention of lead in the matte phase. The composition of the equilibrium phases is shown below:

| CRUCIBLE CHARGE | | CRUCIBLE PRODUCT | |
|---|---|---|---|
| CRUDE BULLION: | 1363.8 g | MATTE: | 11.8 g |
| $Cu_2S$: | 31.8 g | SPEISS: | 37.2 g |
| REACTIVE METAL MIX: | 28.3 g | BULLION: | 1334.1 g |

| | ANALYSES [WT %] | | | |
|---|---|---|---|---|
| ELEMENT | CHARGE | MATTE | SPEISS | BULLION |
| copper | 6.8 | 30.3 | 68.3 | 0.98 |
| sulfur | 1.72 | 20.7 | 0.22 | 0.01 |
| lead | 89.1 | 11.8 | 11.9 | 98.29 |
| tin | 0.11 | 0.76 | 0.79 | 0.051 |
| arsenic | 1.47 | 4.91 | 16.0 | 0.25 |
| silver | 0.20 | 0.064 | 0.145 | 0.182 |
| iron | 0.15 | 5.21 | 0.457 | 0.002 |
| antimony | 0.38 | 0.40 | 2.75 | 0.224 |
| sodium | 0.001 | 22.4 | 0.144 | 0.012 |
| zinc | 0.09 | 1.22 | 0.025 | 0.001 |
| calcium | — | 2.23 | 0.01 | 0.001 |

It can be seen that the combined action of the alkali metal and alkaline earth metal (Na plus Ca) promoted the beneficial separation of elements previously demonstrated for pure sodium metal alone.

EXAMPLES OF TREATING A PREVIOUSLY PRODUCED DROSS

These examples compare the use of RMM to the use of sodium metal in treating a rough copper dross previously produced from lead refining and show that the RMM is equivalent to sodium for this use.

Test Procedure

In each example, a bath of approximately 72 pounds of pure (99.99%) lead was first prepared by placing ingots in a cast iron reactor and raising the temperature of the bath to 550° C. with a gas flame.

In example 4, which was a control experiment, no alkali metal was added to the lead bath.

In examples 5 and 6 an alkali metal/lead alloy was prepared by the addition of either virgin sodium (example 5) or RMM (example 6) in an amount equivalent to approximately 1.9% by weight sodium in the lead bath.

The temperature of the lead or lead/alkali metal bath was raised to 750° C. At that time, a previously-produced dross obtained from a commercial lead refiner was added to the bath while the bath was agitated with a rotary stirring device. The dross was added in three aliquots, and the bath surface was observed for fluidity. About 18.5 pounds of dross were added to the bath in each example, with the dross having the following composition:

| PREVIOUSLY-PRODUCED ROUGH COPPER DROSS | | | |
|---|---|---|---|
| Specie | Wt. % | Specie | Wt. % |
| Copper | 8.48 | Antimony | 0.265 |
| Lead | 61.9 | Gold | 0.00002 |
| Sulfur | 10.60 | Silver | 0.0031 |
| Sodium | 10.64 | Tin | 0.22 |
| Arsenic | 0.67 | Zinc | 3.03 |
| Iron | 4.23 | Bismuth | 0.005 |

This dross already contained considerable sodium from a recycle operation, but this sodium was in a combined form and did not participate in any reduction reactions.

The depth of the fluid matte layer formed in the presence of sodium or RMM was measured and the total volume of the matte layer was estimated. Samples were withdrawn from the fluid mattes and from the lead bullion bath for compositional analysis. In the control experiment, the upper (dross) layer and the bath were sampled similarly.

EXAMPLE 4

In this Example, which was a control experiment that did not include the use of sodium or RMM, the dross did not combine well with the pure lead bath. The dross exhibited no fluid qualities regardless of agitation with the bath. The sample of recovered supernatant material ("matte") analyzed as being most similar to the rough dross added. More than half of the lead charged as dross remained with the "matte" phase. This example showed that heat treatment alone is not effective in promoting mass transfer between phases.

| | COMPOSITIONAL ANALYSES (WT. %) | | | |
|---|---|---|---|---|
| | Materials Charged | | Materials Recovered | |
| Element | Bath | Dross | Bullion | "Matte" |
| Copper | — | 8.48 | 0.143 | 7.62 |
| Sulfur | — | 10.60 | <0.01 | 11.7 |
| Lead | 99.99 | 61.9 | 99.78 | 61.4 |
| Tin | — | 0.22 | <0.01 | 0.01 |
| Arsenic | — | 0.67 | 0.04 | 0.43 |
| Iron | — | 4.23 | <0.001 | 4.76 |
| Antimony | — | 0.265 | <0.005 | 0.12 |
| Sodium | — | 10.64 | 0.001 | 10.1 |
| Zinc | — | 3.03 | <0.001 | 3.88 |
| Bismuth | — | 0.005 | <0.001 | 0.001 |
| Wt. (Lbs.) | 74.16 | 18.38 | 81.22 | 10.38 |
| Total | 92.54 | | 91.6 | |

EXAMPLE 5

In this example virgin sodium metal was added to the lead bath, and it was observed that the dross reduced rapidly to a fluid, supernatant matte. Agitation was discontinued and thematte volume was measured. The phases were sampled, and removed from the reactor. The results of this experiment were as follows:

| | COMPOSITIONAL ANALYSES (Wt. %) | | | | |
|---|---|---|---|---|---|
| | Material Charged | | | Material Recovered | |
| Element | Lead | Sodium | Dross | Bullion | Matte |
| Copper | — | — | 8.48 | 0.082 | 11.64 |
| Sulfur | — | — | 10.60 | <0.01 | 25.5 |
| Lead | 99.99 | — | 61.9 | 98.83 | 5.1 |
| Tin | — | — | 0.22 | 0.01 | 0.04 |
| Arsenic | — | — | 0.67 | 0.06 | 1.15 |
| Iron | — | — | 4.23 | <0.001 | 9.39 |
| Antimony | — | — | 0.265 | 0.012 | 0.60 |
| Sodium | — | 99.94 | 10.64 | 0.989 | 39.3 |
| Zinc | — | — | 3.03 | 0.001 | 7.18 |
| Bismuth | — | — | 0.005 | 0.001 | 0.007 |
| Calcium | — | 0.03 | — | — | — |
| Potassium | — | 0.03 | — | — | — |
| Wt. (Lbs.) | 71.94 | 1.43 | 18.59 | 81.27* | 8.31 |
| Total | 91.96 | | | 89.58* | |

*Includes a heel weight estimate of 5.0 lbs. bullion.

The mass of dross decreased by 56% to a fluid matte layer, which clearly is composed primarily of a copper sulfide/sodium sulfied matte and contains very little lead. 96% of the lead that entered the bath as part of the dross transferred to the bullion.

EXAMPLE 6

In this example, RMM having the following composition was added to the lead bath:

| | |
|---|---|
| Sodium | 68.55 wt. % |
| Calcium | 24.05 wt. % |
| Chloride | 2.75 wt. % |
| Other | 4.65 wt. % |

The RMM had an active ingredient equivalency of 96.2 wt.% pure sodium, based on the equivalence of one mole of calcium to two moles of sodium. This equivalency, however, may be as low as 81% if the chlorides and the "other", which are oxides, tie up calcium stoichiometrically and make it unavailable for reaction with sulfur.

More surface oxidation (flames) occurred when the reactive metal mixture was added, which may have diminished the active ingredient available for reducing sulfides. Upon addition, the RMM tended to form a surface layer above the lead bath until the dross was also added. A fluid matte layer formed, similar to that which occurred when virgin sodium was added. This matte appeared to contain higher freezing components as it readily solidified when skimmed from the reactor. It was mildly more viscous than that for the pure sodium analog. Composition of the materials from this test were:

| | COMPOSITIONAL ANALYSES (Wt. %) | | | | |
|---|---|---|---|---|---|
| | Materials Charged | | | Materials Recovered | |
| Element | Lead | RMM | Dross | Bullion | Matte |
| Copper | — | — | 8.48 | 0.556 | 10.92 |
| Sulfur | — | — | 10.60 | <0.01 | 23.97 |
| Lead | 99.99 | — | 61.9 | 99.30 | 12.15 |
| Tin | — | — | 0.22 | 0.01 | 0.02 |
| Arsenic | — | — | 0.67 | 0.05 | 0.74 |
| Iron | — | — | 4.23 | 0.005 | 8.32 |
| Antimony | — | — | 0.265 | 0.005 | 0.33 |
| Sodium | — | 68.55 | 10.64 | 0.045 | 32.3 |
| Zinc | — | — | 3.03 | 0.006 | 6.43 |
| Bismuth | — | — | 0.005 | 0.001 | 0.005 |
| Calcium | — | 24.05 | <0.001 | <0.004 | 4.77 |
| Wt. (Lbs.) | 73.25 | 1.50 | 18.19 | 83.07 | 8.91 |
| Total | | 92.94 | | 91.98 | |

As with the virgin sodium test, RMM caused the formation of a fluid copper sulfide/sodium sulfide matte phase above the bullion. The mass of dross decreased by 51% as the matte formed. Of the lead previously contained in the dross, 90% precipitated to the bullion layer. The transfer of lead from the dross to the bullion may have been retarded by the higher melting components of the matte or a depletion of active ingredient. Calcium from the RMM quantitatively collected in the matte. The calcium component of the RMM is understood to act in the same fashion as the sodium, liberating lead and accumulating in the matte product as CaS.

I claim:

1. A method for processing crude lead bullion using a reactive metal mixture intermediate by-product comprising sodium and calcium comprising the steps of pouring molten crude lead bullion from a blast furnace into a casting vessel, cooling the crude lead bullion so that a crust forms on top thereof, punching a hole in the crust, injecting a reactive metal mixture intermediate by-product comprising sodium and calcium below the crust and into the crude lead bullion, and allowing the contents of the casting vessel to cool to form three equilibrium phases, including a bottom phase of a refined lead bullion, a speiss phase formed on top of the lead bullion phase and including $Cu_3As$ and $Fe_2As$, and a matte phase formed on top of the speiss phase and including copper, sodium, calcium and sulfur.

2. The method of claim 1, wherein the molten lead bullion has a casting temperature of about 1100°-1200° C.

3. The process of claim 1, wherein the lead bullion is cooled to a temperature of approximately 800° C. to form the crust.

4. The process of claim 1, further comprising adding $Cu_2S$ with the reactive metal mixture intermediate by-product to promote the fluidity of the matte phase.

5. The process of claim 1, wherein the temperature of the reactive metal mixture intermediate by-product added to the crude lead bullion is about 20°-120° C.

6. The process of claim 1, wherein the reactive metal mixture intermediate by-product further comprises alkali metal or alkaline earth metal elements or alloys.

7. The process of claim 6, wherein the alkali metal or alkaline earth metal is selected from the group consisting of potassium, lithium, magnesium, beryllium, and mixtures thereof.

8. The process of claim 1, wherein the reactive metal mixture intermediate by-product is about 2 weight percent of effective sodium of the weight of the crude lead bullion.

9. The method of claim 1, wherein the sulfur content in the crude lead bullion is from 0.35 to 2.3 weight percent.

10. A method for processing a lead dross containing entrained lead using a reactive metal mixture intermediate by-product comprising adding molten lead to a kettle;

agitating the lead, adding a reactive metal mixture intermediate by-product comprising sodium and calcium to the lead to form an alloy of lead, sodium and calcium, adding a lead dross comprising $Cu_2S$, PbS and entrained lead to the alloy, discontinuing the agitation, and allowing the alloy equilibrate to form a matte phase including $Cu_2S$, $Na_2S$, CaS and CaO and a lead phase that includes a portion of the lead that was entrained in the dross.

11. The method of claim 10, further comprising separating the matte phase from the lead phase and recovering the copper entrained in the matte phase.

12. The method of claim 10, wherein the period of time over which the contents of the kettle is allowed to equilibrate is less than or equal to 8 hours.

13. The method of claim 10, wherein the amount of reactive metal mixture waste added to the kettle is about 2 weight percent of equivalent sodium.

14. The method of claim 10, where the mixing temperature in the kettle is about 550° to 750° C.

15. The process of claim 1 or claim 10, wherein the reactive metal mixture intermediate by-product includes 20-95 weight percent sodium, 0-70 weight percent calcium, 0-33 weight percent oxides, metal or alkaline earth metal elements or alloys.

16. The process of claim 1 or claim 10, wherein the reactive metal mixture intermediate by-product is a sodium filtration cake comprising 60-90 weight percent sodium, 10-30 weight percent calcium, 0-10 weight percent oxides, and 0-5 weight percent other alkali metal or alkaline earth metal elements or alloys.

17. The process of claim 1 or claim 10, wherein the reactive metal mixture intermediate by-product is a tankcar and storage tank heel comprising 85-95 weight percent sodium, 0-5 weight percent calcium, and 5-15 weight percent oxides.

18. The method of claim 1 or claim 10, wherein the reactive metal mixture intermediate by-product is processed sodium sludge pellets comprising 20-65 weight percent sodium, 25-70 weight percent calcium and 5-33 weight percent oxides.

* * * * *

UNITED STATES PATENT AND TRADEMARK OFFICE

CERTIFICATE OF CORRECTION

PATENT NO. : 5,100,466

DATED : March 31, 1992

INVENTOR(S) : Michael H. Blenk

It is certified that error appears in the above-identified patent and that said Letters Patent is hereby corrected as shown below:

Column 14,
Claim 15, line 28, after the word "oxides" insert --, and 0-5 weight percent other components such as alkali--.

Signed and Sealed this
Sixth Day of July, 1993

Attest:

Michael K. Kirk

MICHAEL K. KIRK

Attesting Officer

Acting Commissioner of Patents and Trademarks